US006468113B1

(12) United States Patent
Murakami et al.

(10) Patent No.: US 6,468,113 B1
(45) **Date of Patent: *Oct. 22, 2002**

(54) WATERPROOF CONNECTOR

(75) Inventors: Takao Murakami, Shizuoka-ken (JP); Masaru Fukuda, Shizuoka-ken (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 114 days.

(21) Appl. No.: 09/339,693

(22) Filed: Jun. 24, 1999

(30) Foreign Application Priority Data

Jun. 25, 1998 (JP) ..... 10-178971

(51) Int. Cl.[7] ..... H01R 13/514; H01R 13/52; H01R 13/40

(52) U.S. Cl. ..... 439/752; 439/274; 439/275; 439/589

(58) Field of Search ..... 439/752, 595, 439/271, 283, 274, 275, 587, 589

(56) References Cited

U.S. PATENT DOCUMENTS

| | | | | |
|---|---|---|---|---|
| 3,879,239 | A | 4/1975 | Rager et al. | 156/73.1 |
| 4,083,902 | A | 4/1978 | Clyde | 264/26 |
| 4,640,567 | A | 2/1987 | Lundergan et al. | 339/94 |
| 4,662,629 | A | 5/1987 | Plovie | 272/62 |
| 4,662,692 | A | 5/1987 | Uken et al. | |
| 4,684,187 | A | 8/1987 | Rudy, Jr. et al. | 439/600 |
| 4,708,662 | A | 11/1987 | Klein | 439/353 |
| 4,713,021 | A | 12/1987 | Kobler | 439/272 |
| 4,776,813 | A | 10/1988 | Wilson et al. | 439/587 |
| 4,944,688 | A | 7/1990 | Lundergan | 439/275 |
| 4,969,260 | A | 11/1990 | Kondo et al. | 29/863 |
| 4,976,634 | A | 12/1990 | Green et al. | 439/589 |
| 4,979,913 | A | 12/1990 | Aiello et al. | 439/596 |
| 5,116,236 | A | 5/1992 | Colleran et al. | 439/271 |
| 5,120,269 | A | 6/1992 | Endo et al. | 439/752 |

(List continued on next page.)

FOREIGN PATENT DOCUMENTS

| | | |
|---|---|---|
| EP | 0 299 797 | 1/1989 |
| EP | 0 546 753 A 1 | 6/1993 |
| EP | 0 691 710 A2 | 1/1996 |
| EP | 0 700 125 A2 | 3/1996 |
| EP | 0 778 636 A1 | 6/1997 |

(List continued on next page.)

OTHER PUBLICATIONS

European Search Report dated Oct. 4, 1999.

*Primary Examiner*—Tulsidas Patel
*Assistant Examiner*—Chaudrika Prasad
(74) *Attorney, Agent, or Firm*—Finnegan, Henderson, Farabow, Garrett & Dunner, L.L.P.

(57) ABSTRACT

An inner housing is formed with terminal accommodation chambers for accommodating terminals at ends of electric wires, an outer housing fitted on the inner housing has, in opposition to the terminal accommodation chambers, outside locations of a bottom wall portion formed with wire insertion holes and, at inside locations of the bottom wall portion opposite to the wire insertion holes, rubber plug reception recesses for receiving waterproof rubber plugs for sealing the terminal accommodation chambers, and the outer housing comprises an inner wall portion integrated with the bottom wall portion, the inner wall portion having an accommodation space for the inner housing to be fitted therein, and an outer wall portion separated from an assembly of the inner wall portion and the bottom wall portion, to be provided thereabout in a spaced manner relative to the inner wall portion, the outer wall portion being removably attached to the assembly.

12 Claims, 2 Drawing Sheets

U.S. PATENT DOCUMENTS

| | | | | | |
|---|---|---|---|---|---|
| 5,215,635 | A | | 6/1993 | Stein et al. | 204/157.62 |
| 5,240,431 | A | | 8/1993 | Yagi et al. | |
| 5,266,045 | A | | 11/1993 | Yamamoto et al. | 439/275 |
| 5,316,504 | A | | 5/1994 | Jinno | 439/752 |
| 5,419,722 | A | | 5/1995 | Onoda | 439/752 |
| 5,490,572 | A | | 2/1996 | Tajiri et al. | 180/65.1 |
| 5,498,170 | A | | 3/1996 | Tanaka | 439/271 |
| 5,562,477 | A | | 10/1996 | Moore et al. | |
| 5,569,050 | A | | 10/1996 | Lloyd | 439/465 |
| 5,580,264 | A | | 12/1996 | Aoyama et al. | 439/275 |
| 5,596,261 | A | | 1/1997 | Suyama | 320/48 |
| 5,613,868 | A | | 3/1997 | Ohsumi et al. | 439/275 |
| 5,707,251 | A | | 1/1998 | Sakai et al. | 439/589 |
| 5,709,563 | A | | 1/1998 | Saito | 439/275 |
| 5,730,627 | A | | 3/1998 | Okabe | 439/752 |
| 5,782,657 | A | * | 7/1998 | Wolla et al. | 439/595 |
| 5,803,773 | A | | 9/1998 | Kashiyama et al. | 439/752 |
| 5,836,788 | A | | 11/1998 | Torii | 439/587 |
| 5,860,834 | A | | 1/1999 | Sugiyama | 439/595 |
| 5,931,699 | A | * | 8/1999 | Saito | 439/587 |
| 5,931,707 | A | | 8/1999 | Ito | 439/752 |
| 5,947,774 | A | | 9/1999 | Abe | 439/701 |
| 5,980,317 | A | * | 11/1999 | McNeel | 439/281 |
| 5,984,737 | A | | 11/1999 | Nagano et al. | 439/752 |

FOREIGN PATENT DOCUMENTS

| | | | |
|---|---|---|---|
| GB | 2 168 548 | A2 | 6/1986 |
| GB | 2 321 346 | A | 7/1998 |
| GB | 2 321 347 | A | 7/1998 |
| GB | 2 321 792 | A | 8/1998 |
| GB | 2 321 802 | A | 8/1998 |
| JP | 50-54591 | | 5/1975 |
| JP | 61-12621 | | 4/1986 |
| JP | 62-188069 | | 11/1987 |
| JP | 64-63282 | | 3/1989 |
| JP | 4-49480 | | 4/1992 |
| JP | 4-101380 | | 9/1992 |
| JP | 5-152028 | | 6/1993 |
| JP | 6-217412 | | 8/1994 |
| JP | 6-295750 | | 10/1994 |
| JP | 7-22079 | | 1/1995 |
| JP | 7-122331 | | 5/1995 |
| JP | 7-298450 | | 11/1995 |
| JP | 8-186901 | | 7/1996 |
| JP | 9-45376 | | 2/1997 |
| JP | 10-60096 | | 3/1998 |
| JP | 10-92478 | | 4/1998 |
| WO | WO 92/15133 | | 9/1992 |
| WO | WO 9632760 | | 10/1996 |
| WO | WO 9736346 | | 10/1997 |

* cited by examiner

WATERPROOF CONNECTOR

BACKGROUND OF THE INVENTION

1. Field of the Invention

The present invention relates to a waterproof connector of a compact multipolar type that has an enhanced waterproof nature between a connector housing assembly and a plurality of electric wires provided with terminals attached to their ends.

2. Description of the Relevant Art

Such a type of waterproof connector is disclosed in Japanese Patent Application No. 10-60096 filed in Japan by the assignee of the present application.

This waterproof connector comprises: a connector housing assembly having a terminal accommodating cavity and a number of separated wire leading cavities which communicate with outside via a number of diameter-reduced wire insertion holes formed in an outer wall of the housing assembly and with the terminal accommodating cavity via a number of diameter-reduced wire insertion holes formed in an inner wall of the housing assembly; a number of waterproof rubber plugs fitted watertight in the wire leading cavities and formed with wire leading holes; a number of female terminals set in positions in the terminal accommodating cavity; and a number of insulated electric wires provided through the wire insertion holes at the outer end, the wire leading holes in the rubber plugs and the wire insertion holes at the inner end, and connected at their ends to the terminals.

The housing assembly comprises a synthetic-resin-made inner housing, a synthetic-resin-made outer housing loose-fitted on the inner housing, and a synthetic-resin-made spacer inserted tight between the inner and outer housings. The outer housing has a rear wall portion constituting the above-mentioned outer wall formed with the wire insertion holes at the outer end, and the spacer has a rear wall portion constituting the above-mentioned inner wall formed with the wire insertion holes at the inner end. The inner housing and the spacer as well as the outer housing have their front end faces exposed outside.

The terminal accommodating cavity is defined by the inner housing and the spacer, and is partitioned by walls into a number of terminal accommodation chambers for accommodating therein the female terminals. The wire leading cavities are defined by the outer housing and the spacer, and are sealed with the rubber plugs fitted therein.

The outer housing may be damaged for external causes, such as by undue forces, and may be replaced with new one. However, the waterproof connector has sealing rubber plugs, and such replacement needs cutting electric wires connected to female terminals or disconnecting the wires from the terminals before removal of the damaged outer housing or after disassembly of entire connector housing, as well as reconnecting the wires to the terminals before re-assembly of the connector housing. Such services for maintenance takes a significant amount of man-hours.

SUMMARY OF THE INVENTION

The present invention has been achieved with such points in view.

It therefore is an object of the present invention to provide a waterproof connector improved for replacement of a damaged outer housing member, by a possible partial replacement, with an eliminated redundancy for wire disconnection and reconnection, without the need of disassembling and reassembling an entire connector.

To achieve the object, an aspect of the present invention provides a waterproof connector comprising an outer housing member having a hollow, and an inner connector assembly independently waterproof, removably fitted in the hollow and disengageably locked to the outer housing member.

According to this aspect of the invention, an outer housing member may be solely damaged. However, an inner connector assembly can be disengaged from the damaged outer housing member, to be wholly removed out of a hollow of the outer housing member. Then, the inner connector assembly, which is independently waterproof, can be fitted in a hollow of a new outer housing member, to be locked to this outer housing member. Accordingly, there is achieved the object described.

Another aspect of the invention provides a waterproof connector comprising a combination of a terminal, a waterproof rubber member and an electric wire provided through the waterproof rubber member and connected to the terminal, an inner housing accommodating the terminal, and an outer housing accommodating the inner housing and the waterproof rubber member, the outer housing comprising a first housing member enclosing the waterproof rubber member and fixed to the inner housing, the first housing member being formed with a wire insertion hole for the electric wire to be lead therethrough, and a second housing member removably fitted on and disengageably locked to the first housing member.

According to this aspect of the invention, a first housing member is cooperative with an inner housing and a combination of a terminal, a water seal rubber member and an electric wire to constitute an independently waterproof inner connector assembly, and a second housing member serves as an outer housing member.

Another aspect of the invention provides a waterproof connector including an inner housing formed with terminal accommodation chambers for accommodating therein terminals at ends of electric wires, and an outer housing in which the inner housing is fitted and which has, in opposition to the terminal accommodation chambers, outside locations of a bottom wall portion formed with wire insertion holes and, at inside locations of the bottom wall portion opposite to the wire insertion holes, rubber plug reception recesses for receiving waterproof rubber plugs for sealing the terminal accommodation chambers, wherein the outer housing comprises an inner wall portion integrated with the bottom wall portion, the inner wall portion having an accommodation space for the inner housing to be fitted therein, and an outer wall portion separated from an assembly of the inner wall portion and the bottom wall portion, to be provided thereabout in a spaced manner relative to the inner wall portion, the outer wall portion being removably attached to the assembly.

According to this aspect of the invention, an outer housing is divided into an inner wall portion and an outer wall portion to be arranged in an inside and outside relationship, and an inner housing is fitted in the inner wall portion. The inner wall portion is responsible for provision of places for wire insertion and a base for fixation of terminals connected to electric wires, etc. Necessary functions for waterproof connection are confined within the inner wall portion.

The outer wall portion provided outside the inner wall portion surrounds the inner wall portion, and is adapted to be attached to and detached from the inner wall portion. The outer wall portion constitutes an outermost member of a connector housing assembly, which is liable to receive external forces acting on the connector. The outer wall portion may be damaged or broken, but can be removed from the inner wall portion, to be replaced with a new one to provide a complete waterproof connector.

Connector components within the inner wall portion are left as they have been, and kept intact from maintenance services, such as for wire cutting and disconnection from terminals. Reassembling work of an entire connector is unnecessary, either.

BRIEF DESCRIPTION OF THE DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENT

There will be detailed below the preferred embodiments of the present invention with reference to the accompanying drawings.

Figure 1:
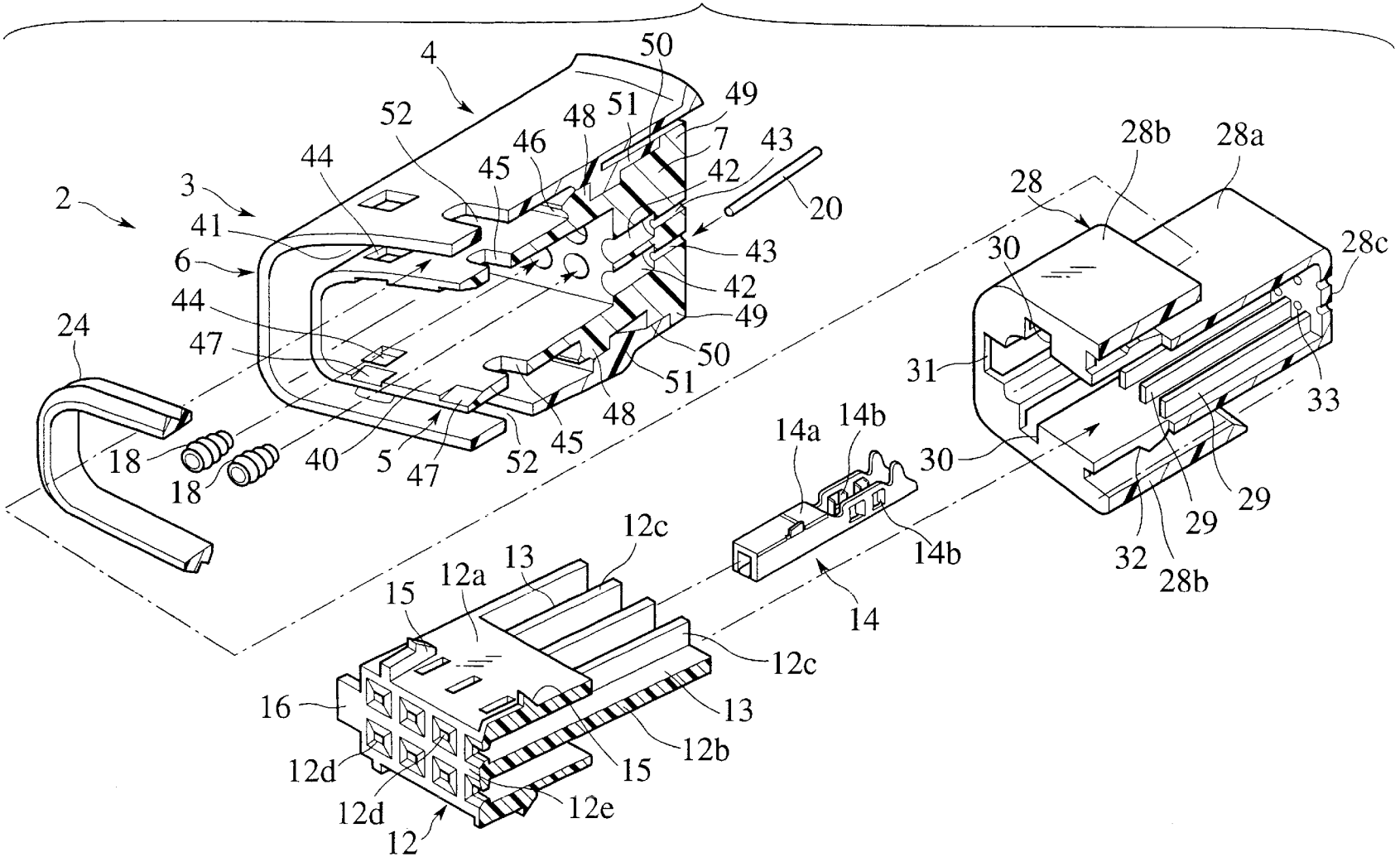
FIG. 1 is an exploded perspective view of a waterproof connector according to an embodiment of the invention.
Figure 2:
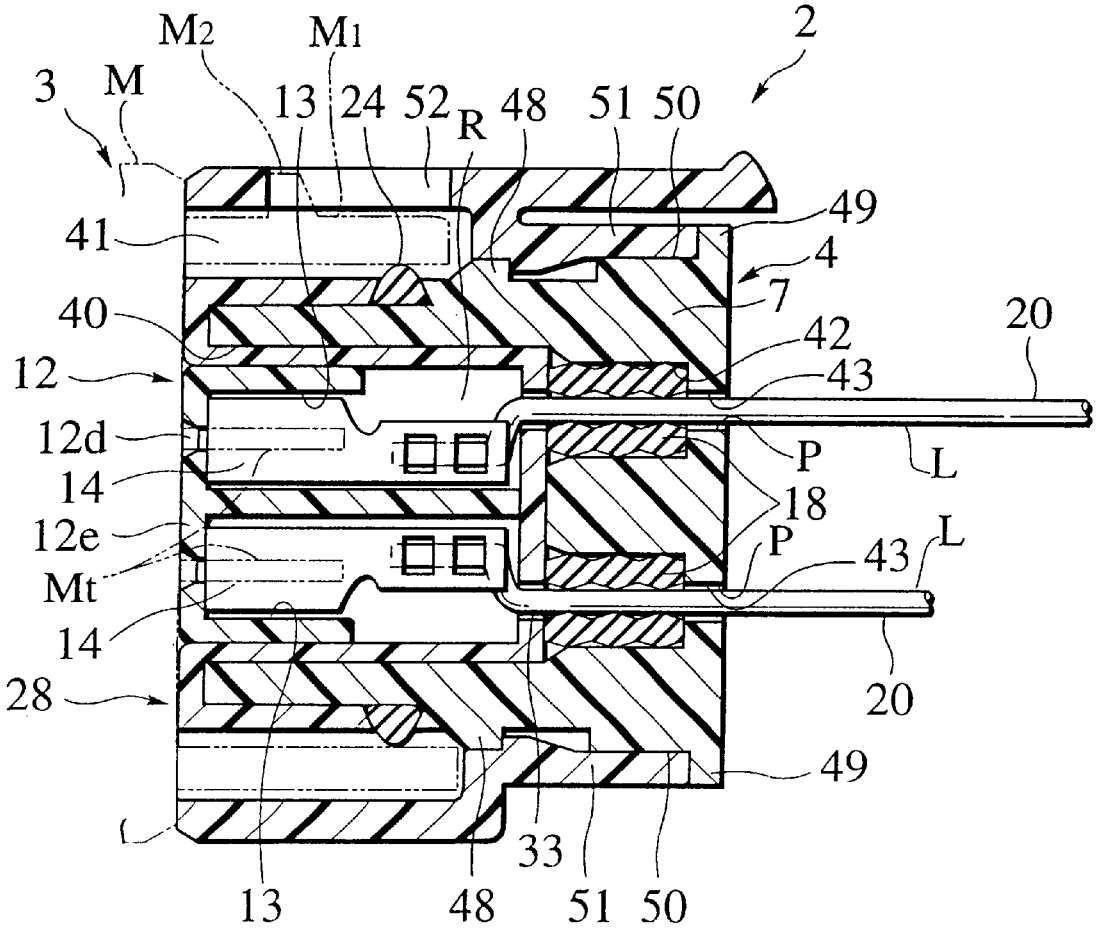
FIG. 2 is a longitudinal section of the waterproof connector of FIG. 1.

FIG. 1 shows a waterproof male connector 2 according to an embodiment of the invention, and FIG. 2, a longitudinal section of the male connector 2 in an assembled state.

As illustrated in FIG. 2, the waterproof connector 2 comprises: a number of electrical connection lines L each having an insulated electric wire 20 and an insulation displacement type metallic female terminal 14 contacting a conductive core at a nonstripped end of the electric wire 20; a connector housing assembly 3 of resin-mold pieces defining a terminal accommodating region R as a combination of upper and lower arrays of mutually communicating accommodation chambers 13 for accommodating terminals 14, as well as a combination of upper and lower arrays of corresponding insertion holes 12*d* for insertion of male terminals Mt of a mating waterproof female connector M of a resin mold assembly type and a combination of upper and lower arrays of corresponding paths P for electric wires 20 to be lead therethrough into the terminal accommodation region R; and a combination of upper and lower arrays of corresponding waterproof rubber plugs 18 of a corrugated barrel or tubular form fitted watertight to inside surfaces of the wire leading paths P and outside surfaces of the wires 20.

As the female connector M is a waterproof type, the terminal accommodating region R of the male connector 2 has no more potential communication with outside than along terminal insertion holes 12d and abutment clearances between the male and female connectors 2 and M. However, such abutment clearances also are waterproofed with a hood M1 of the female connector M. The hood Ml contacts watertight on a waterproof packing ring 24 of the male connector 2 and is locked by projections M2 on its outside engaged with locking holes 52 of the connector 2.

As shown in FIGS. 1 and 2, the connector housing assembly 3 includes an assembled combination of an inner housing 12 molded with a synthetic resin and a spacer 28 molded with a synthetic resin, in the form of a male housing assembly which has an outside configuration adapted to mate in the hood M1 and inner structures for defining the terminal accommodating region R and for partitioning the region R into the arrays of terminal accommodation chambers 13.

The inner housing 12 is plugged inside the spacer 28. The connector housing assembly 3 further comprises an outer housing 4 fitted to the male housing assembly. The outer housing 4 is separable into inner and outer wall portions 5 and 6, and is component-wise molded with a synthetic resin. The spacer 28 is fitted tight in the inner wall portion 5, with rubber plugs 18 disposed therebetween, and the outer wall portion 6 is removably fitted on and disengageably locked to the inner wall portion 5. Respective mold pieces are dimensioned to be practically flexible.

In other words, the connector 2 comprises: the outer wall portion 6 as a hollow or tubular housing member; and an inner connector assembly independently waterproof, removably fitted in a hollow of the housing member 6 and disengageably locked to the housing member 6, wherein the inner connector assembly comprises: an assembled combination of the inner wall portion 5, the spacer 28 and the inner housing 12, as a waterproof enclosure with the rubber plugs 18 incorporated therein; and electrical connection lines L.

Referring again to FIG. 1, the inner housing 12 comprises a box-shaped wall portion 12*a* open rearwards, a vertically central horizontal wall 12*b* separating an inner region of the box-shaped wall portion 12*a* into upper and lower regions, and a combination of upper and lower arrays of longitudinally extending vertical partition walls 12*c* formed on upside and downside of the central horizontal wall 12*b*.

Each female terminal 14 is installed in the inner housing 12, to be accommodated in a corresponding terminal accommodation chamber 13. Respective female terminal 14 comprises a single metallic piece formed with a square female contact 14*a* for receiving a male contact of the mating terminal Mt inserted therein, and a wire connection part having a pair of lateral contact blades 14*b* for insulation displacement.

Respective terminal accommodation chamber 13 is defined by the box-shaped wall portion 12*a* including a front wall 12*e*, which has insertion holes 12*d* for the male terminals Mt of the mating connector M to be plugged therein, the central horizontal wall 12*d*, the upper and lower arrays of vertical partition walls 12*c*, and an enclosing body of the spacer 28.

The spacer 28 comprises a substantially rectangular tubular barrel portion 28*a*, and a substantially rectangular tubular flange portion 28*b* as a similarly enlarged front extension of the barrel portion 28*a* reversed to be folded back thereover. When assembled to the outer housing 4, the barrel portion 28*a* of the spacer 28*a* is fitted inside the inner wall portion 5 of the outer housing 4, and the flange portion 28*b* is fitted outside the inner wall portion 5. The barrel portion 28*a* has an array of axial ribs 29 each provided on an inside thereof for a retaining engagement with a rear end of the square female contact 14*a* of corresponding terminal 14, as well as for abutment on a rear edge of the box-like wall portion 12*a*.

As can be seen in FIGS. 1 and 2, inner wall portion 5 comprises a first inner wall portion 5, 28*c* and a second inner wall portion formed by a portion of flange portion 28*b*. Inner wall portion 5 cooperates with flange portion 28*b* and rectangular tubular barrel portion 28*a* of spacer 28 to form a waterproof wall of the inner connector assembly. Outer wall portion 6 forms a replaceable outer wall which encloses the waterproof wall. Replaceable outer wall 6 is disengageably locked to the waterproof wall 5, 28.

The combination of upper and lower arrays of wire leading paths P (FIG. 2) comprises: a combination of upper and lower arrays of wire insertion holes 33 provided through the spacer 28; a combination of upper and lower arrays of wire sealing holes that are provided as corrugated hollow portions of upper and lower arrays of rubber plugs 18 plugged watertight in upper and lower arrays of rubber plug receiving recesses 42 which constitute diameter-enlarged front parts of ports provided through a rear wall of the inner wall portion 5 of the outer housing 4; and a combination of upper and lower arrays of wire insertion holes 43 provided as diameter-reduced rear parts of the ports provided through the rear wall of the inner wall portion.

The wire insertion holes 33 are formed at a rear end of the spacer 28, i.e., at a so-called "bottom" wall portion 28*c* thereof. The bottom wall portion 28*c* closes a rear end of the barrel portion 28*a* of the spacer 28, with a designed thickness for adaptation of the spacer 28 to be brought into a watertight sealing contact with front end faces of rubber plugs 18, as well as to push the rubber plugs 18 to be compressed against walls of the recesses 42 and sufficiently deformed for an ensured watertight sealing on both inner and outer sides of the plugs 18.

The outer housing 4 is a combination of separable two pieces, one being the inner wall portion 5 fixed to the spacer 28, and the other being the outer wall portion 6 surrounding the inner wall portion 5. The inner wall portion 5 is formed in a tubular configuration substantially rectangular in section to define an accommodation space 40 for the barrel portion 28*a* of the spacer 28 to be inserted thereto. The outer wall portion 6 also is formed in a substantially rectangular tubular configuration dimensioned to be spaced from the inner wall portion 5, with a sufficient radial distance or gap 41 to allow for the hood M1 of the mating connector M to be smoothly inserted therein, as well as for the projections M2 thereon to be brought into locking engagement with the locking holes 52, and for operations to disengage the projections M2 from the locking holes 52.

The inner and outer wall portions 5 and 6 are open at their front ends, so that the spacer 28 can be pushed to force the barrel portion 28*a* to be fitted in the accommodation space 40 in the inner wall portion 5 from the front end, together with the flange portion 28*b* to be inserted into the gap 41 from the front end with a spacing left for insertion of the hood M1 of the mating connector M.

The inner wall portion 5 of the outer housing 4 is closed at its rear end with a relatively thick "bottom" wall portion 7 to be sealed, as described. The rubber plug receiving recesses 42 are formed at front locations of the bottom wall portion 7 corresponding to the terminal accommodation chambers 13, with a circular cross section relatively large in diameter to allow for the waterproofing rubber plugs 18 to be inserted with force. The wire insertion holes 43 are formed through a remaining thickness of the bottom wall portion 7, with a circular cross section relatively small in diameter to simply allow for the electric wires 20 to be lead therethrough.

Each waterproof rubber plug 18 comprises a substantially cylindrical rubber piece slightly longer than a depth of recess 42, which rubber piece is corrugated at both inside and outside and formed with an axial through hole normally having a minimum inside diameter for insertion of electric wire 20. When the rubber piece is compressed, the inside diameter is reduced to effect a watertight sealing along the wire 20.

The box-shaped wall portion 12*a* of the inner housing 12 is formed with upper and lower horizontal walls flush at front ends with, but shorter in axial length than, the central horizontal wall 12*b*. The upper and lower walls of the box-shaped wall portion 12*a* each have three vertically projecting engagement pawls 15 formed at the front end thereof. The three engagement pawls 15 fit in notches 30 formed in corresponding locations of a corresponding one of upper and lower front parts of the spacer 28, where a front part of the inner wall portion 5 engages. Of the three pawls 15, left and right ones (15) are for disengageable locking engagement into rectangular engagement holes 44 opened at corresponding locations on a corresponding one of upper and lower parts of the inner wall portion 5 of the outer housing 4; and the remaining central one (15) is for disengageable locking engagement into an elongated rectangular engagement hole 45 opened at a central location on a corresponding one of the upper and lower parts of the inner wall portion 5. To permit a facilitated engagement of the pawls 15, the inner wall portion 5 has,tapered faces 47 formed at corresponding location inside a front edge thereof. The box-shaped wall portion 12*a* has a pair of lateral projections or flanges 16 for engagement with a pair of notches 31 formed in both lateral sides of an entry of the spacer 28.

As shown in FIGS. 1 and 2, the inner wall portion 5 is stepwise enlarged or radially swelled in a rear half thereof so that a straight front circumference ends at an axially central location, where a first step rises in a forwardly overhanging manner to define a V-shaped groove 46 (FIG. 1). The groove 46 receives a rear one of tapered side edges of the waterproof rubber packing 24. The first step has a short top (FIG. 2) followed by a tapered front shoulder of a second step constituting a circumferentially continuously or intermittently extending axially central engagement projection 48. The second step has a relatively short top, of which a rear shoulder is right-angled and steps down to a level of the first step to define a front end of a circumferential slot rectangular in section. An axially straight bottom of the slot ends substantially at a half position of the rear half of the inner wall portion 5, where a third step rises to have a relatively long top extending straight at an even level to the top of the second step. The long top of the third step ends near the rear end of the inner wall portion 5, where an axially short and radially highest fourth step rises to define a circumferentially continuously or intermittently extending rear engagement projection 49, so that the slot and the third step are cooperative to define a stepped groove 50 relative to the rear engagement projection 49. The groove 50 receives a substantially conformally engaging stepped extension or projection 51 that radially inwardly and axially rearwardly extends from a central part of the outer wall portion 6 of the outer housing 4.

In other words, outside the inner wall portion 5, at an axial bottom of the gap 41 there is formed a V-shaped packing receiving groove 46 for reception of the waterproof rubber packing 24, and behind the V-shaped groove 46 there are formed a pair of axially opposing engagement projections 48 and 49, with an intervening stepped engagement groove 50 therebetween.

When the outer wall portion 5 is assembled, the stepped projection 51 engages into the stepped groove 50 between the engagement projections 48 and 49 of the inner wall portion 5.

More specifically, when the outer wall portion 6 is slid onto the inner wall portion 5 from behind, the stepped projection 51 engages into the stepped grooves 50 of the inner wall portion 5, so that a stepped front edge of the projection 51 engages with the rear shoulder of the engagement projection 48 and a rear edge of the projection 51 slips into abutment on a front face of the engagement projection 49 in a locking manner, allowing the outer wall portion 6 to be mounted on the inner wall portion 5.

Then, the wires 20 are connected to the terminals 14, and the spacer 28 is fitted to the inner wall portion 5 of the outer housing 4. Then, the inner housing 12 is fitted inside the spacer 28.

In the foregoing embodiment, an outer housing 4 is constituted by two members: an inner wall portion 5, and an outer wall portion 6 located at an outermost position of a connector housing assembly 3. External forces act on the outer wall portion 6, which may then be damaged or broken. Even if the outer wall portion 6 be damaged, it can be removed from the inner wall portion 5 with ease, and another outer wall portion 6 can be assembled on the inner wall portion 5. It therefore is unnecessary to cut wires 20 or disconnect cut wires 20 from terminals 14. It also is unnecessary to reassemble an entirety of the connector housing assembly 3. Thus, time is saved with an improved maintenance nature.

Further, in the embodiment, the outer wall portion 6 has a locking hole 52 for disengageable locking engagement with a projection M2 on a hood M1 of a mating female connector M, to effectively share a necessary watertight sealing function of a waterproof male connector 2.

Further, a spacer 28 formed with rubber plug receiving recesses 42 allows for waterproof rubber plugs 18 to be reduced in diameter independently of a size of terminal accommodation chambers 13, so that neighboring terminals 14 can have a reduced pitch to provide a waterproof connector with an increased pole density.

It will be seen that an inner housing 12 may be directly fitted in an outer housing 4, without using a spacer 28. Terminals 14 may be any other type else, e.g. a crimp type solder-less terminal.

While preferred embodiments of the present invention have been described using specific terms, such description is for illustrative purposes, and it is to be understood that changes and variations may be made without departing from the spirit or scope of the following claims.

What is claimed is:

1. A waterproof connector comprising:

an outer housing member having a tubular portion open at both ends; and an inner connector assembly independently waterproof, removably fitted in the tubular portion and disengageably locked to the outer housing member, the inner connector assembly having a bottom wall portion formed with wire insertion holes.

2. The waterproof connector of claim 1, wherein:

the outer housing member has a projection projecting from a wall of the tubular portion; and the inner connector assembly has a waterproof enclosure spaced from the wall of the tubular portion and formed with a recess lockingly engagable with the projection, a terminal accommodation space defined by the enclosure, and a sealing member sealing the terminal accommodation space.

3. A waterproof connector comprising:

a combination of a terminal, a waterproof rubber member and an electric wire provided through the waterproof rubber member and connected to the terminal;

an inner housing accommodating the terminal; and an outer housing accommodating the inner housing and the waterproof rubber member, the outer housing comprising a first housing member enclosing the waterproof rubber member and fixed to the inner housing, the first housing member having a bottom wall portion formed with a wire insertion hole for the electric wire to be lead therethrough, and a tubular second housing member removably fitted on and disengageably locked to the first housing member.

4. The waterproof connector of claim 3, wherein:

the first housing member comprises a tubular resin enclosure with a recess formed thereon; and the second housing member comprises a resin casing formed with an inner projection lockingly engageable with the recess on the tubular resin enclosure.

5. A waterproof connector including:

an inner housing formed with terminal accommodation chambers for accommodating therein terminals at ends of electric wires; and an outer housing in which the inner housing is fitted and which has, in opposition to the terminal accommodation chambers, outside locations of a bottom wall portion formed with the wire insertion holes and, at inside locations of the bottom wall portion opposite to the wire insertion holes, rubber plug reception recesses for receiving waterproof rubber plugs for sealing the terminal accommodation chambers, wherein the outer housing comprises:

an inner wall portion integrated with the bottom wall portion, the inner wall portion having an accommodation space for the inner housing to be fitted therein; and a tubular outer wall portion separated from an assembly of the inner wall portion and the bottom wall portion, to be provided thereabout in a spaced manner relative to the inner wall portion, the outer wall portion being removably attached to the assembly.

6. The waterproof connector of claim 5, wherein the outer wall portion has an engaging portion engageable with a mating connector.

7. A waterproof structure for a connector comprising:

a terminal connected to an electric wire;

a waterproof wall cooperative with a mating connector to waterproof a terminal accommodation space in which the terminal is accommodated, the waterproof wall having a bottom wall portion formed with a wire insertion hole for the electric wire to be inserted therethrough; and a replaceable outer wall enclosing the waterproof wall, the outer wall being engaged with the waterproof wall and configured to be replaceable even when damaged.

8. The waterproof structure of claim 7, wherein the waterproof wall comprises a first inner wall portion formed with an electric wire leading path for leading the electric wire to the terminal accommodation space, and a second inner wall portion, including the bottom wall portion, inserted in a hood portion of the mating connector, and the outer wall comprises a tubular portion loose-fitted on the first inner wall portion and the hood portion, and an engaging portion for engaging the tubular portion with the first inner wall portion.

9. The waterproof structure of claim 8, further comprising:

a first seal member for sealing the electric wire leading path; and a second seal member for sealing a gap between the hood portion and the second inner wall portion.

10. A waterproof structure for a connector comprising:

a terminal connected to an electric wire;

a waterproof wall cooperative with a mating connector to waterproof a terminal accommodation space in which the terminal is accommodated, the waterproof wall having a bottom wall portion formed with a wire insertion hole for the electric wire to be inserted therethrough; and a replaceable outer wall enclosing the waterproof wall, the outer wall protecting substantially an entirety of the waterproof wall.

11. The waterproof structure of claim 10, wherein the waterproof wall comprises a first inner wall portion formed with an electric wire leading path for leading the electric wire to the terminal accommodation space, and a second inner wall portion, including the bottom wall portion, inserted in a hood portion of the mating connector, and the outer wall comprises a tubular portion loose-fitted on the first inner wall portion and the hood portion, and an engaging portion for engaging the tubular portion with the first inner wall portion.

12. The waterproof structure of claim 11, further comprising:

a first seal member for sealing the electric wire leading path; and a second seal member for sealing a gap between the hood portion and the second inner wall portion.

* * * * *

UNITED STATES PATENT AND TRADEMARK OFFICE

CERTIFICATE OF CORRECTION

PATENT NO. : 6,468,113 B1
DATED : October 22, 2002
INVENTOR(S) : Takao Murakami and Masaru Fukuda It is certified that error appears in the above-identified patent and that said Letters Patent is hereby corrected as shown below:

Column 7,
Line 53, “engagable” should read -- engageable --.

Signed and Sealed this

Eighteenth Day of March, 2003

JAMES E. ROGAN
*Director of the United States Patent and Trademark Office*